US005547633A

United States Patent [19]

Muddle et al.

[11] Patent Number: 5,547,633

[45] Date of Patent: Aug. 20, 1996

[54] ALUMINUM-TITANIUM ALLOY

[75] Inventors: Barry C. Muddle; Jianfeng Nie, both of Melbourne, Australia

[73] Assignee: Monash University, Clayton Victoria, Australia

[21] Appl. No.: 312,156

[22] Filed: Sep. 23, 1994

Related U.S. Application Data

[63] Continuation of Ser. No. 911,217, Jul. 10, 1992, abandoned.

[51] Int. Cl.[6] ..... C22C 21/00

[52] U.S. Cl. ..... 420/552; 148/549; 148/551; 148/698; 148/699; 148/702; 148/415; 148/416; 148/437; 148/438; 148/440; 420/543; 420/551

[58] Field of Search ..... 148/549, 551, 148/698, 699, 702, 415, 416, 437, 438, 439, 440, 403; 420/535, 543, 551, 552

[56] References Cited

U.S. PATENT DOCUMENTS 4,347,076 8/1982 Ray et al. ..... 148/549

4,595,429 6/1986 Le Caer et al. ..... 148/439

FOREIGN PATENT DOCUMENTS 3-249148 11/1991 Japan .

*Primary Examiner*—David A. Simmons
*Assistant Examiner*—Robert R. Koehler
*Attorney, Agent, or Firm*—Kerkam, Stowell, Kondracki & Clarke, P.C.; John C. Kerins

[57] ABSTRACT

The specification describes a ternary alloy of aluminium. The alloy described comprises from 80 to 96% by weight of aluminium and from 4 to 20% by weight of titanium and a third element selected from the group consisting of cobalt, chromium, copper, magnesium, nickel and iron. The weight ratio of titanium to ternary alloying element lies in the range from 1:1 to 6:1. The alloy can be aged at a temperature in the range from 300° to 450° C.

5 Claims, 1 Drawing Sheet

ALUMINUM-TITANIUM ALLOY

This is a continuation of application Ser. No. 07/911,217 filed Jul. 10, 1992, now abandoned.

BACKGROUND OF THE INVENTION

The present invention relates to ternary alloys of aluminium and titanium.

A common approach to design of high strength aluminium alloys for elevated temperature applications involves production of alloy microstructures comprising a large volume fraction of finely and homogeneously dispersed, thermally stable intermetallic particles. Those alloying elements favoured in such developments are those miscible with aluminium in the liquid state and having low solid solubilities and diffusivities in the solid state, for these will contribute to low coarsening rates of the strengthening dispersoids. Similarly, the preferred intermetallic phases are those which are intrinsically stable at elevated temperatures and which possess low interfacial energy in an aluminiummatrix. The production of suitable microstructures commonly involves rapid solidification processing, during which the solubility of alloying elements may be increased and a large volume fraction of fine-scale dispersoids may be generated either directly from the melt during rapid quenching, or from supersaturated solid solution by suitable post-solidification heat treatments.

The most successful group of alloys developed using this approach has been that based on the Al-Fe system, with ternary and often quaternary additions. However, in these alloys, the dispersed intermetallic phases mostly form directly from the melt during rapid solidification and are relatively coarse in scale. The alloys themselves are of relatively high density, since to achieve the required volume fractions of dispersed phases requires large concentrations (8–12 wt %) of what are commonly higher density solute elements (Fe, Mo, V, Zr, Cr, Ce). There thus remains scope for the design and development of improved alloys, particularly alloys of lower density, refined microstructure and improved thermal stability.

Of the possible alternatives, the Al-Ti system appears one of the most promising. The titanium is low density and has low solid solubility and diffusivity in aluminium. Under conditions of rapid solidification, formation of the equilibrium intermetallic phase $Al_3Ti$ (b.c.t., $DO_{22}$) is generally suppressed and replaced by a metastable ordered cubic ($Ll_2$) phase, that is sub-stoichiometric with respect to titanium ($\sim Al_4Ti$). The metastable intermetallic particles have a cube-cube orientation relationship and a low lattice misfit with the matrix phase, and would thus be expected to possess a low interfacial energy. However, in binary Al-Ti alloys, the metastable intermetallic phase forms directly from the melt, and is thus relatively coarse in scale (0.1–0.3 μm). In addition, the volume fraction of fine-scale, solid state intermetallic precipitates is low in quenched and aged microstructures and the distribution is inhomogeneous [6,7]. Limited attempts have been made to refine microstructures by ternary alloying additions to rapidly quenched dilute Al-Ti binary alloys. However, detailed analysis of the rapidly quenched microstructures and the microstructural evolution during post-solidification ageing treatments has received little attention.

An object of the present invention is to provide ternary alloys of aluminium and titanium of high strength.

SUMMARY OF THE INVENTION

Accordingly, the present invention provides an aluminium alloy comprising from 80% to 96% by weight of aluminium and from 4–20% by weight of titanium and a ternary alloying metal selected from the group consisting of cobalt, chromium copper, magnesium, nickel and iron, wherein the weight ratio of titanium to the ternary alloying metal lies in the range from 1:1 to 6:1.

Preferably, the weight ratio of titanium to ternary alloying metal lies in the range from 2:1 to 4:1. The preferred ternary alloying metal is nickel.

The alloy may be aged by heating to a temperature in the range between 300° and 450° C. in a salt bath for a period sufficient to optimise its hardness. The hardness of the alloys may be measured by a micro-indentation instrument (UMIS 2000). This instrument uses a triangular based diamond pyramid indentor with a face angle of 65.3° and a load in the range from 1 to 200 mN. The maximum penetration depth is 2 micron. In use the indentor is applied to the surface of the sample with a force of 0.1 mN. The instrument monitors the forces and displacements during indentation. Hardness is determined as a function of the depth to which the indentor penetrates. The measurements produced by the instrument can be transposed into equivalent Vickers hardness (EVH) values expressed in kilograms per sq mm. For heat treatments at 400° C. the hardness of the alloy can reach a maximum of 170 EVH after about 5 hours.

DETAILED DESCRIPTION OF THE INVENTION

Figure 1:
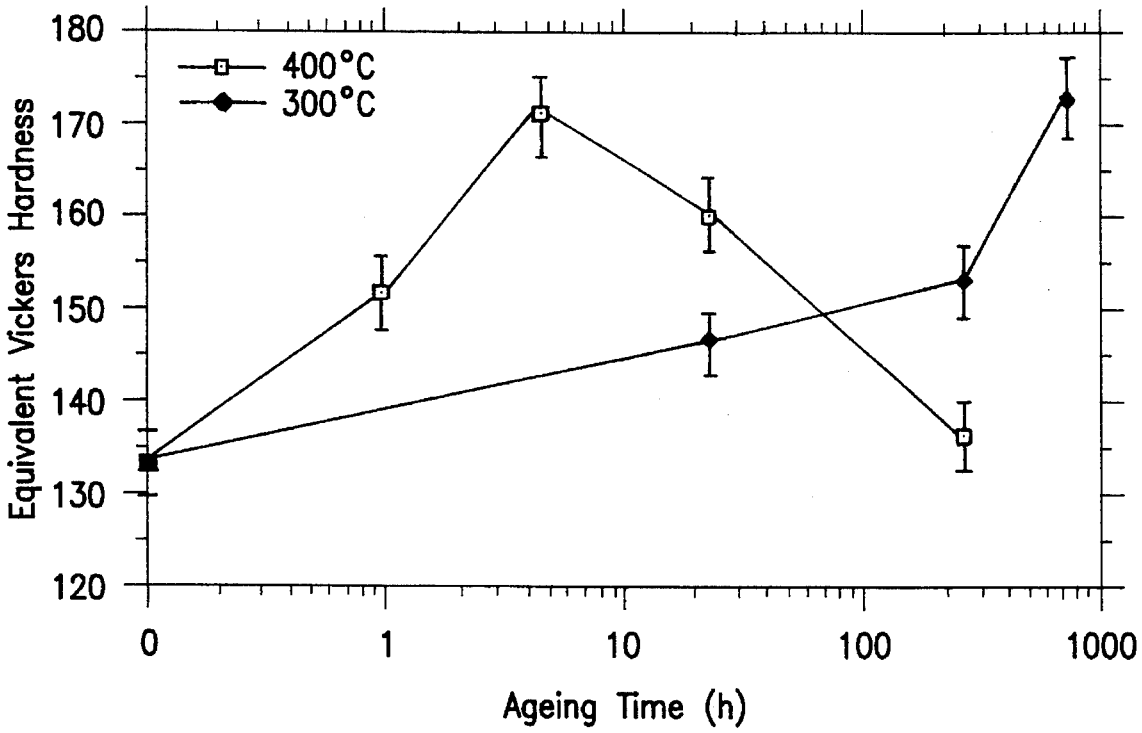

The following experimental information illustrates the invention.

A series of Al-Ti-Ni alloys, with total solute concentrations in the range 5–20 wt %, were prepared in ribbon form, from high purity Al (99.99%), Ti (99.8%) and Ni (99.9%), by chill block melt spinning in a controlled helium environment at 1 atmosphere pressure. Details of the melt-spinning process are reported [Nie, J. F., SRIDHARA, S. AND MUDDLE, B. C., Metall. Trans. A, in press (1992)]. The resultant ribbons were approximately 40 μm in thickness and 2 mm in width. Sections of ribbon were subsequently heat treated in a salt bath for up to 720 h in the temperature range 300°–500° C. (±2° C.). Samples for electron microscopy were punched mechanically from the ribbon and thinned to perforation by twin-jet electropolishing in a solution of 40% acetic acid, 30% orthophosphoric acid, 20% nitric acid and 10% water at 11V open circuit and room temperature. All thin foils were examined in a Philips EM420 transmission electron microscope, equipped with an EDAX PV9900 x-ray spectrometer and operating at 120 kV.

To assess the ageing response of the alloys, the hardness of the ribbons was measured using a micro-indentation instrument (UMIS 2000, C.S.I.R.O. Division of Materials Science and Technology, Australia). This instrument uses a triangular-based diamond pyramid indentor with a face angle of 65.3°, the level of load ranges from 1 to 200 mN, and the maximum penetration depth is 2 μm. Measurement involves bringing the indentor to the surface of the sample with a small contact force (0.1 mN) and then monitoring continuously the forces and displacements associated with indentation. Hardness is determined as a function of penetration depth. To assess the reliability of the technique, hardness measurements were made on both melt-spun ribbons and bulk samples of annealed, pure aluminium and on bulk samples of a peak-aged, high strength precipitation-hardening aluminium alloy, hereinafter referred to as its trademark name of WELDALITE 049™. Micro-indentation measurements for pure Al produced average hardness values of 28 and 32 kg $mm^{-2}$ (equivalent Vickers hardness, EVH) for thin ribbon and bulk samples respectively, and 214 kg $mm^{-2}$ for the bulk WELDALITE 049™sample. These values are to be compared with conventional bulk Vickers hardness numbers of 17 VHN (2.5 kg load) and 197 VHN (5 kg load) for bulk samples of pure Al and WELDALITE 049™ respectively. This preliminary data suggests that hardness values defined by the UMIS 2000 are systematically 15–17 VHN higher than those determined using standard Vickers hardness testing.

EXPERIMENTAL RESULTS

The presence of as little as 1 wt % Ni in Al-Ti alloys containing up to 6 wt % Ti was found to result in the suppression of not only the equilibrium primary phase $Al_3Ti$, but also the metastable cubic (L12) intermetallic phase (~$Al_4Ti$) in rapidly solidified ribbons produced under the present conditions. The as-solidified microstructures invariably contained a fine-scale distribution of novel metastable intermetallic phase(s) in a supersaturated f.c.c. matrix. After preliminary work to evaluate the effects of varying composition on solidification microstructure and response to post solidification heat treatment, the most promising results were observed in those alloys in which the weight ratio Ti:Ni was in the range 3:1 to 4:1. Further work was focussed on results obtained for an Al-6Ti-1.5Ni(wt %) alloy. These results typify the behaviour of alloys having a weight ratio of Ti:N: in the range from 3:1 to 4:1.

Rapidly-Solidified Microstructure

Electron micrographs and selected area diffraction patterns of the thin ribbons were obtained at various stages during production of the aged alloy. The microstructure contained of the rapidly generated alloy a fine-scale (<100 nm) and uniformdistrlbution of mostly cuboidal intermetallic dispersoids in an μ-Al matrix phase. The dispersoids were randomly oriented with respect to the matrix phase, and a dense distribution of dislocations was frequently observed around them. Electron microdiffraction patterns recorded systematically from the dispersoids revealed the presence of at least two metastable phases within the distribution. Those particles with a regular cuboidal shape gave rise to patterns that could, be indexed consistently according to a metastable face-centred cubic crystal structure (space group, Fm3c), with a lattice parameter a=2.40±0.05 nm. A small fraction of the dispersoids could be distinguished to have the form of platelets and these were found to exhibit an orthorhombic crystal structure with a=1.80 nm, b=2.20 nm and c=1.40±0.05 nm.

The as-quenched Al-6Ti-1.5Ni alloy ribbons were found to have an average microhardness of 133 kg $mm^{-2}$(EVH).

A BRIEF DESCRIPTION OF THE DRAWING

FIG. 1 is a chart showing the results of micro-indentation hardness measurements as a function of aging time in an Al-6Ti- 1.5 Ni alloy.

Ageing Response

The thermal stability of the rapidly solidified microstructure in the Al-6Ti-1.5Ni alloy was examined by carrying out isothermal ageing treatments in the temperature range 300°–500° C. These treatments generated a strong ageing response, as indicated in the results of micro-indentation hardness measurements recorded in FIG. 1. For heat treatments at 400° C., the microhardness rises rapidly to a maximum of approximately 170 EVH after 5 h and then declines. It remains, however, approximately equivalent to that of the as-quenched alloy after 240 h exposure at 400° C. With isothermal heat treatment at 300° C., the average microhardness increases steadily with increasing ageing time, reaching a value of approximately 173 EVH after 720 h (30 days). At this point the existing results suggest that the hardness may still be increasing and longer term heat treatments remain in progress to assess this possibility.

Microstructural Changes During Ageing

The primary intermetallic dispersoids of the metastable f.c.c. phase in the as-quenched microstructure were unstable and decomposed rapidly (<1 h) on ageing at 400° C. to form the metastable $Ll_2$ phase. This process was accompanied by homogeneous precipitation of coherent, metastable $Ll_2$ particles within the matrix phase. In addition to the decomposition of the coarse, primary particles, there is evidence of a very fine-scale contrast modulation within the matrix phase. This is associated with the development of fine-scale precipitation, that is not fully homogeneous in distribution but reasonably uniform throughout the matrix phase. The SAED pattern, recorded parallel to an $<001>_\alpha$ zone axis in the sample aged 5 h at 400° C., FIG. 4(*c*), contains the additional weaker reflections that are characteristic of the ordered cubic ($Ll_2$) structure. The $Ll_2$ phase has a lattice parameter (a=0.404 nm) very similar to that of pure aluminium (a=0.4059 nm) and the metastable precipitates (β') are coherent with the matrix phase, sharing an identity orientation relationship of the form:

$(001)_{\beta'}//(001)_\alpha$, $[100]\beta,//[100]_\alpha$.

During the course of ageing, growth of the metastable precipitates was observed to involve gradual extension along all three <001> directions, giving rise to a transitional, three dimensional cross-like morphology. Structural analysis of the cross-like precipitates using electron microdiffraction indicated that they comprised three orthogonal variants of a superlattice structure that varied from the $Ll_2$ structure to a b.c. tetragonal ($DO_{23}$) structure (a=0.40 nm, c=1.73 nm). The $D_{23}$ structure may be described as a one-dimensional, long-period superstructure derived from the $Ll_2$ crystal lattice by periodic shear displacements of ½[110](001) between every two $Ll_2$ to $DO_{23}$ occurred slowly via the formation of a series of metastable transition superlattices. The accompanying structural changes could be modelled successfully assuming aperiodic shear displacements of ½[110](001) between one-dimensional stacks of $Ll_2$ unit cells. Throughout this period of the ageing treatment the precipitates remained coherent with the matrix phase.

During prolonged ageing at 400° C., the cross-like precipitates evolved into incoherent, spheroidal or rod-like particles of the equilibrium tetragonal $DO_{22}$ phase, $Al_3Ti$. At 500° C. the ageing process was accelerated and relatively coarse, incoherent particles of the equilibrium phase were present after just 24 h at temperature. However, at 300° C. decomposition of the alloy was sluggish and the specimen aged for 240 h exhibited the fine-scale modulated contrast indicative of the early stages of coherent precipitation of the $Ll_2$ phase.

SUMMARY

Melt-spinning of an Al-6Ti-1.5Ni (wt %) alloy has produced a microstructure of fine (<100 nm), dispersed particles of metastable phases randomly oriented with respect to α-Al matrix phase. The particles are surrounded by a dislocation network and their form and distribution, together with the absence of a crystallographic relationship with the matrix phase, suggest that they form as primary particles directly from the melt, perhaps as a result of micro-cellular solidification. The dispersion of primary particles comprises a mixture of at least two novel, metastable phases: one is f.c.c. (space group, Fm3c) with a=2.40±0.05 nm, the other is orthorhombic (point group, mmm) with a=1.80, b=2.20 and c=1.40±0.05 nm.

With isothermal ageing in the temperature range 300°–500° C., the metastable primary phases prove unstable and decompose rapidly. Initial ageing is, however, accompanied by a substantial increase in hardness and transmission electron microscopy has revealed that this is associated with uniform, fine-scale solid state precipitation of coherent $Ll_2$ phase. At 400° C., a maximum hardness of 170 EVH is achieved after ~5 h, apparently as a result of a critical dispersion of $Ll_2$ precipitate particles. With increased ageing time there is a progressive transformation and coarsening of the particles, initially to a metastable tetragonal $DO_{23}$ structure and eventually to equilibrium tetragonal ($DO_{22}$) $Al_3Ti$. These changes are accompanied by a decline in hardness, but the hardness remains equivalent to that of the as-quenched alloy (i.e. ~130 EVH) after 240 h at 400° C., and at this stage of ageing the microstructure still contains a dispersion of fine, coherent precipitates. At 300° C., the kinetics of precipitation are sluggish and a fine-scale dispersion of coherent $Ll_2$ particles remains present after 720 h. The micro-indentation hardness is at this point ~175 EVH and apparently still increasing.

Since conventional precipitation hardened aluminium alloys over-age and soften rapidly at temperatures in the range from 150° to 200° C., the alloys of the present invention have significant commercial potential especially in applications involving elevated temperatures.

We claim:

1. An aluminum alloy produced by rapid solidification processing and consisting of at least 80% by weight of aluminum, at least 6% by weight of titanium, and a further alloying metal selected from the group consisting of cobalt, chromium, copper, magnesium, and nickel, wherein the weight ratio of titanium to the further alloying metal lies in the range from 2:1 to 4:1.

2. An aluminum alloy according to claim 1 wherein the further alloying metal is nickel and the ratio of titanium to nickel lies in the range from 3:1 to 4:1.

3. A method of producing an age hardened aluminum alloy by rapid solidification processing which method comprises mixing titanium and a further alloying element with molten aluminum, forming the molten alloy into a ribbon or sheet, quenching the ribbon or sheet and heating the quenched ribbon or sheet to a temperature in the range between 300°–450° C. for a period sufficient to optimize the hardness of the ribbon or sheet; wherein the alloy consists of at least 80% by weight of aluminum, at least 6% by weight of titanium, and a further alloying metal selected from the group consisting of cobalt, chromium, copper, magnesium, and nickel, wherein the weight ratio of the titanium to the further alloying metal lies in the range from 2:1 to 4:1.

4. A method according to claim 3 wherein the further alloying element is nickel and the weight range of titanium to nickel lies in the range 3:1 to 4:1.

5. An aluminum alloy prepared by the method according to claim 3.

* * * * *